United States Patent [19]

Kaminkow et al.

[11] Patent Number: 4,934,699

[45] Date of Patent: Jun. 19, 1990

[54] PINBALL MACHINE WITH GATE-RAMP

[75] Inventors: Joseph E. Kaminkow, Arlington Heights; Edwin Cebula, West Chicago, both of Ill.

[73] Assignee: Data East Pinball, Inc., Melrose Park, Ill.

[21] Appl. No.: 441,468

[22] Filed: Nov. 27, 1989

[51] Int. Cl.[5] ..... A63F 7/00

[52] U.S. Cl. ..... 273/121 A; 273/127 C

[58] Field of Search ..... 273/121 A, 121 E, 127 C, 273/127 D, 181 J, 182 R

[56] References Cited

U.S. PATENT DOCUMENTS 4,773,646 9/1988 Joos, Jr. et al. ..... 273/121 A

*Primary Examiner*—Randall L. Green
*Assistant Examiner*—Gary Jackson
*Attorney, Agent, or Firm*—George H. Gerstman

[57] ABSTRACT

In a pinball machine a structure holding a ramp and targets is provided on the playfield to create a gate-like covering for an opening and passage to other targets and areas of the playfield. When a ball travelling on the ramp strikes the targets carried by the ramp, the ramp is pivoted to its open position revealing an opening and passage to other targets and areas of the game.

10 Claims, 4 Drawing Sheets

4
32
38
24
26
34
34(e)
30
20
30(d)
30(e)
36(e)
16
36
4

5
32
38
24
35(d)
30(e)
46
26
30(a)
35(b)
30(c)
42
34
50
40
34(e)
44
36
36(e)
56
52
20
54
5

PINBALL MACHINE WITH GATE-RAMP

FIELD OF THE INVENTION

The present invention concerns a novel pinball machine with a moveable ramp that alloys for play on the ramp.

BACKGROUND OF THE INVENTION

The object in pinball games is to acquire points by hitting targets. By providing various kinds of targets, in various situations, a pinball machine can remain an exciting game over time. Electronic arcade games are able to provide challenges because of their ability to influence players to continue to play to increase skills.

In pinball machines, the impetus to a player to continue to play derives from the granting of additional points or play balls or a free game. However, the replaying of the same game may become boring. The present invention provides targets for the acquisition of points and refreshes the game by providing a challenge as the play progresses and the player becomes skilled.

The present invention guards any of a variety of different play options from play until the player can acquire skills necessary to defeat a gate-like mechanism that protects these play options.

It is an object of the present invention to provide players the challenge of a changing game to meet the players acquisition of skills, and thus keep the game interesting for a greater period of time.

Another object of the present invention is to provide a ramp device for a pinball machine that is simple to construct and is easy to manufacture.

Other objects and advantages of the invention will become apparent as the description proceeds.

SUMMARY OF THE INVENTION

In accordance with an embodiment of the present invention, a pinball machine with a playfield is provided. A ramp pivotally connected to a supporting structure is carried by the playfield. A first target is carried by the ramp at an angle to the slope of the ramp to allow the engagement of the first target with a ball travelling on the ramp. A second target, means defining an opening beneath the ramp, and means defining a path from the opening to the second target are provided. Means are provided for pivoting the ramp, so that the ramp is raised to a first position to allow access by a ball to the opening beneath the ramp and then lowered, to a second position, to allow a ball to engage the first target by travelling on the ramp.

In the illustrative embodiment, the targets provided are targets that, upon being struck either singly or in a preselected combination of strikes, give the player points and cause a signal to be sent to a motor which causes the ramp to pivot.

In the illustrative embodiment, the pivoting means include means responsive to the first target being struck by a ball or a series of strikings by a ball. The responsive means electrically signal a motor connected to a crankshaft causing the crank to rotate and the shaft, attached to the ramp, to rise thereby pivoting the ramp and allowing access to the playfield under the ramp.

In the illustrative embodiment, the ramp is a wedge shaped shell of metal. The ramp is attached at its rearward and lower end to said structure by means of an axial pin allowing the pivoting of the ramp.

In the illustrative embodiment, the structure holding the ramp is carried by the playfield of the pinball machine and comprises two walls oppositely placed and perpendicular to the axis of pivot of the ramp, with a roof. This structure provides lateral stiffness and support for the ramp.

A more detailed explanation of the invention is provided in the following description and claims, and is illustrated in the accompanying drawings.

DETAILED DESCRIPTION OF THE ILLUSTRATIVE EMBODIMENT

Figure 1:
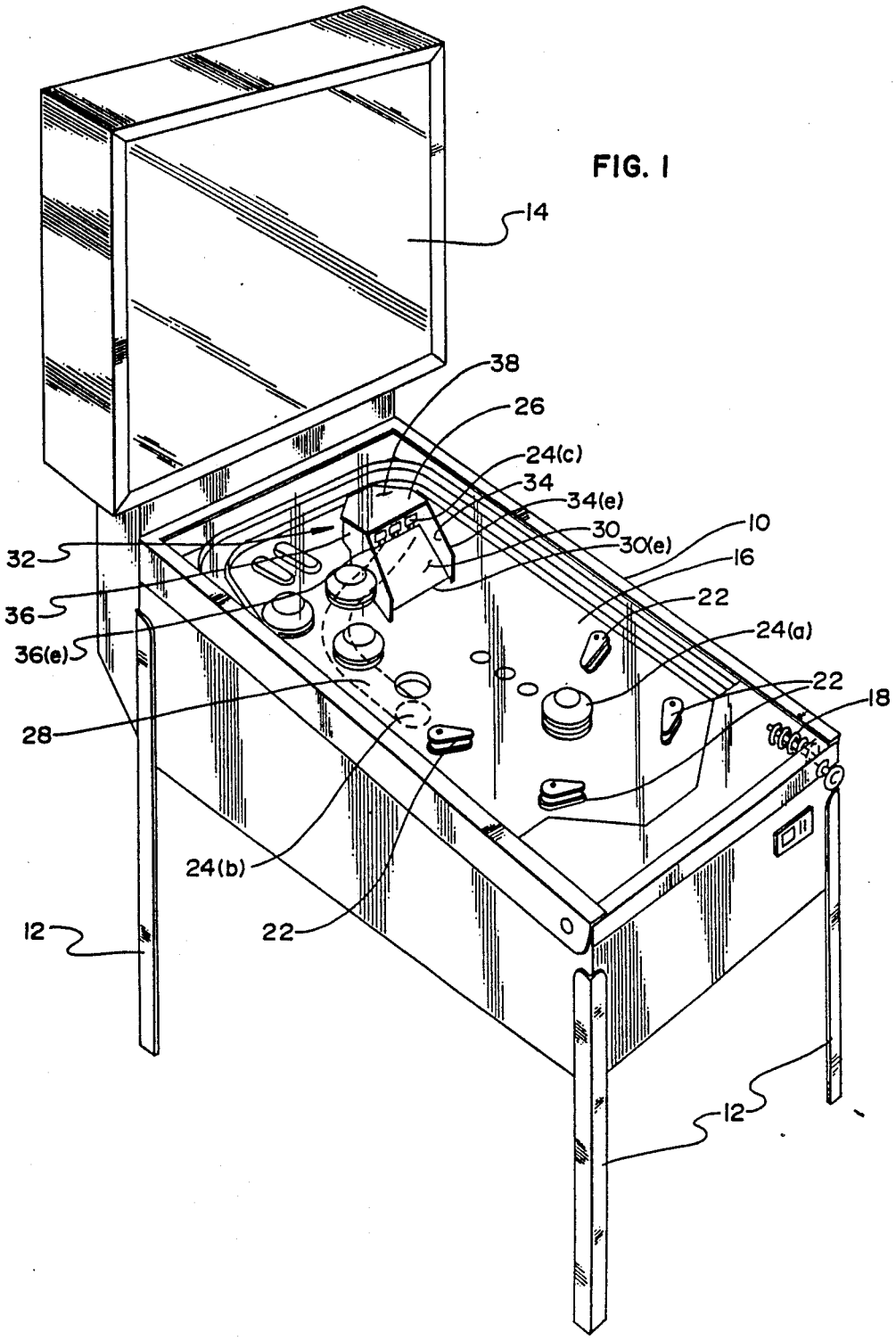
FIG. 1 is a perspective view of a pinball machine constructed in accordance with the principles of the present invention.

Referring to the drawings, FIG. 1 shows a pinball machine comprised of a central body 10 attached to a plurality of legs 12, with a scoreboard 14 and a playfield 16. A ball launcher 18 is provided to propel a ball 20 onto the playfield 16 where the ball 20 can be struck by a plurality of flippers 22 and can strike a plurality of targets 24. Also shown in FIG. 1 are some of the types of targets available for this pinball machine; they include bumpers 24(*a*), ball ejectors 24(*b*), and face targets 24(*c*). A ramp and target structure 26 on the playfield 16 is provided and explained in detail below. A path 28 is defined below the playfield 16, by a "U" shaped-elongated member 28(*a*), shown in FIGS. 4 and 5, leading from below the ramp and target structure 26 to another point on the playfield 16.

Figure 2:
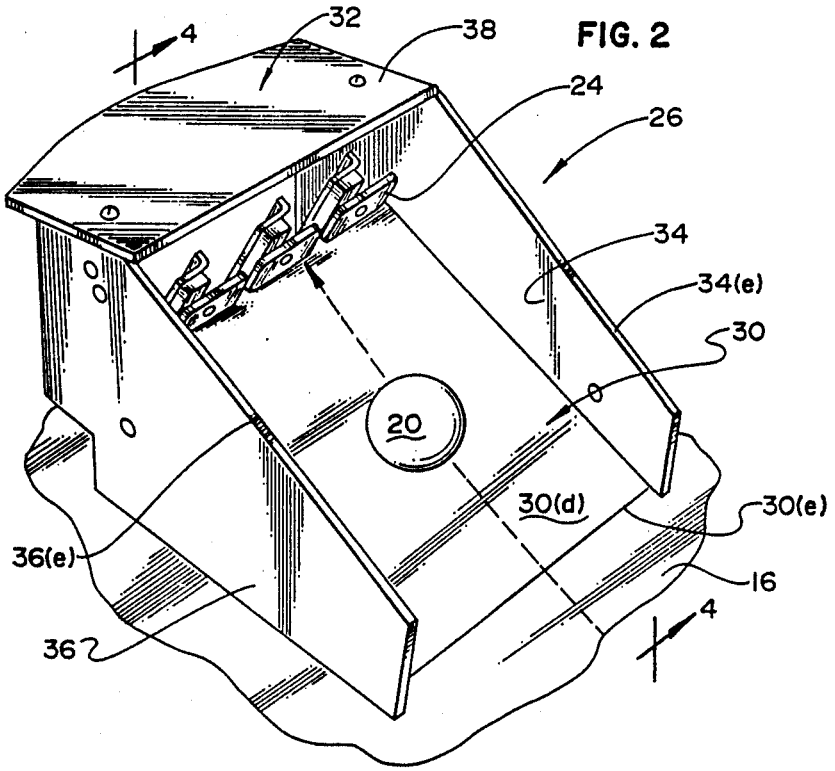
FIG. 2 is a perspective view of a target system in one position on the pinball machine of FIG. 1.
Figure 3:
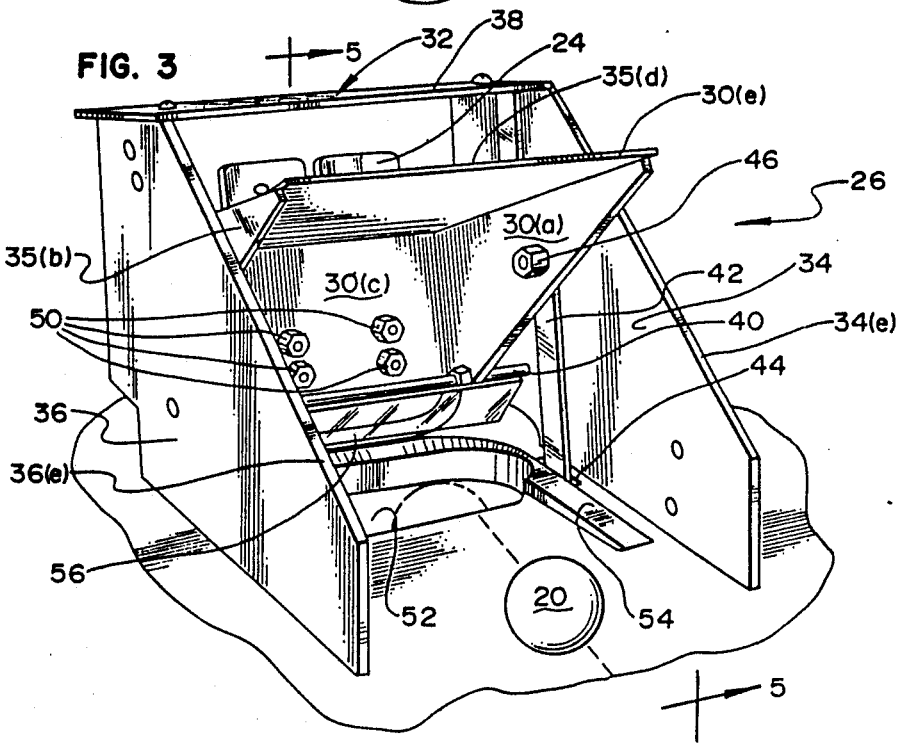
FIG. 3 is similar to FIG. 2 showing the target system in another position.

FIGS. 2 and 3 show the ramp and target structure 26 in greater detail. In FIG. 2, a ramp structure 30 is shown in its lowered, or first, position. The ramp and target structure 26 comprises a ramp structure 30, targets 24 and a support structure 32.

The support structure 32 includes a first wall 34 and a second wall 36 placed parallel to each other and a roof 38 joining the walls 34 and 36. In the illustrative embodiment the edges 34(*e*) and 36(*e*) of the walls 34 and 36, respectively, slope down from the roof 38 to slightly beyond the edge 30(*e*) of the ramp structure 30, at an angle similar to the slope of the ramp structure 30. The edges 34(*e*) and 36(*e*) are squared off, forming leading edges of at least one ball diameter in height. In this way the ramp structure 30 is more easily viewed during play and still prevents the ball 20 from rolling off of the sides of the ramp structure 30.

FIG. 3 shows the ramp structure 30 in its raised position and exposes more of the detail of the ramp and target structure 26. The ramp structure 30 is comprised of a first wall 30(*a*), a second wall 30(*b*), a third wall 30(*c*), and the ramp surface 30(*d*). The first wall 30(*a*) and the second wall 30(*b*) are parallel to each other and generally triangular in shape and are attached to the third wall 30(*c*), which is generally rectangular in shape, at the short leg side of the first wall 30(*a*) and the second wall 30(*b*). The ramp surface 30(*d*) is rectangular in shape and is attached to walls 30(*a*), 30(*b*) and 30(*c*), forming a wedge shaped shell.

The ramp structure 30 is attached to the support structure 32 by means of a pin 40 attached to the wall 34 and the wall 36 and extending through the ramp structure 30, through the wall 30(*a*) and the wall 30(*c*) at their lower and rearward ends. The ramp structure 30 can also be attached by other fasteners, such as rivets or bolts that allow for pivoting, attached at both sides of the ramp structure 30 and the support structure 32.

FIG. 3 shows a shaft 42 which protrudes through the playfield 16 at a slot 44 and rotationally attaches at one end by means of a bolt 46 or similar fastener, to the ramp structure wall 30(*a*) and at its other end to a crank 48, at point 48(*c*).

Targets 24 are attached to the ramp structure wall 30(*c*) by means of bolts 50 or similar fasteners. The size of the ramp and target structure 26 allows for a plurality of targets to be installed thereon.

An opening 52, beneath the ramp structure 30, in the playfield 16 is encircled, for about one half of its circumference, by ball-guide 54, which forms a rim around the back part of the opening 52, to cause the ball 20 propelled towards the ramp structure 30, in its raised position, to go into the opening 52 and not past it. The ball-guide 54 tapers at its distal end so as to be flush with the playfield 16.

A mirrored flange 56 is attached to the playfield 16, by means of bolts or similar fasteners, below the ramp structure 30 and between the pin 40 and the ball-guide 54. The mirrored flange 56 enables the player to view the opening 52 and the ball action, thus allowing hand-eye coordination by the player and to enable the ball 20 to rebound in a desired manner.

Figure 4:
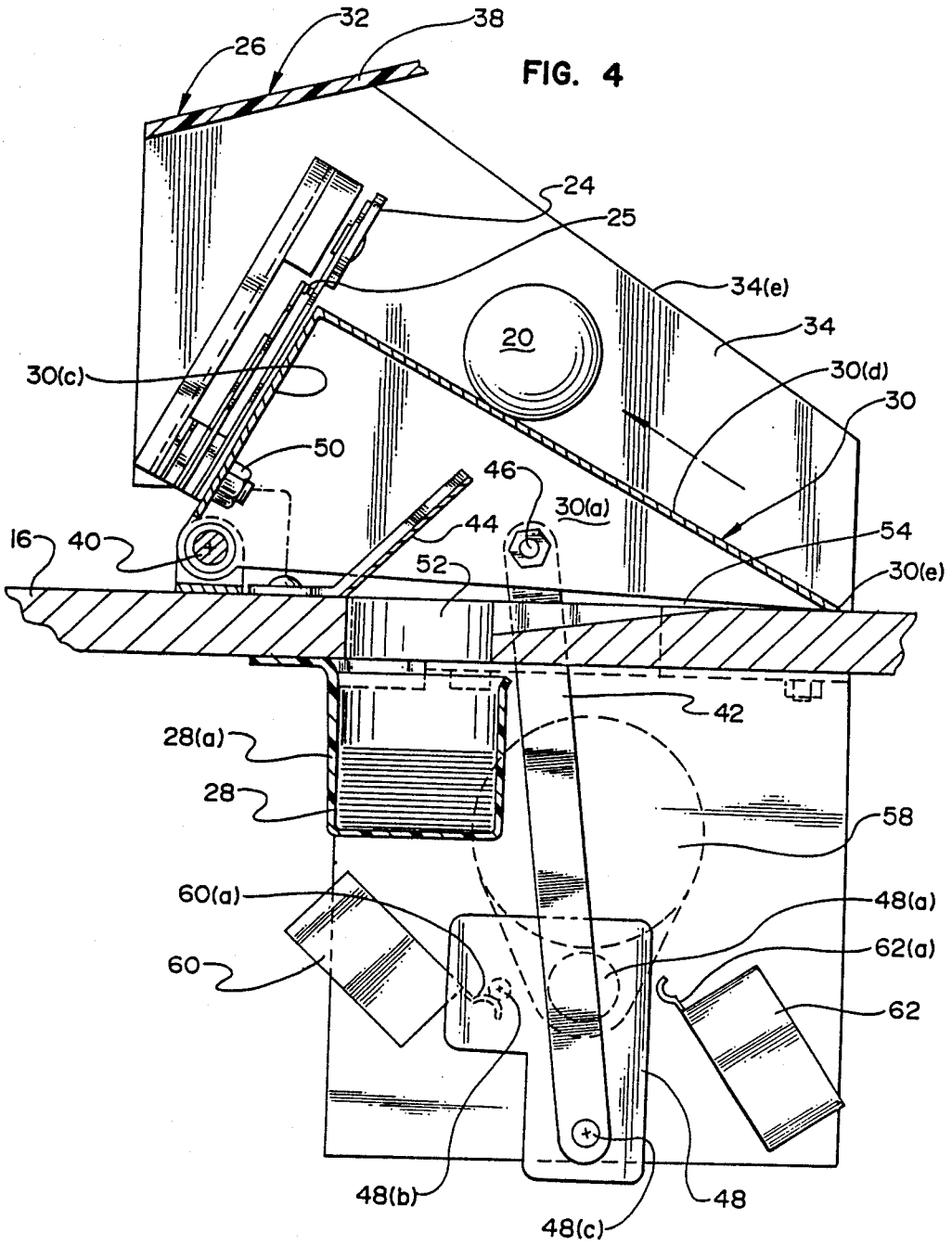
FIG. 4 is a cross-sectional elevation taken along the plane of the line 4—4 of FIG. 2.
Figure 5:
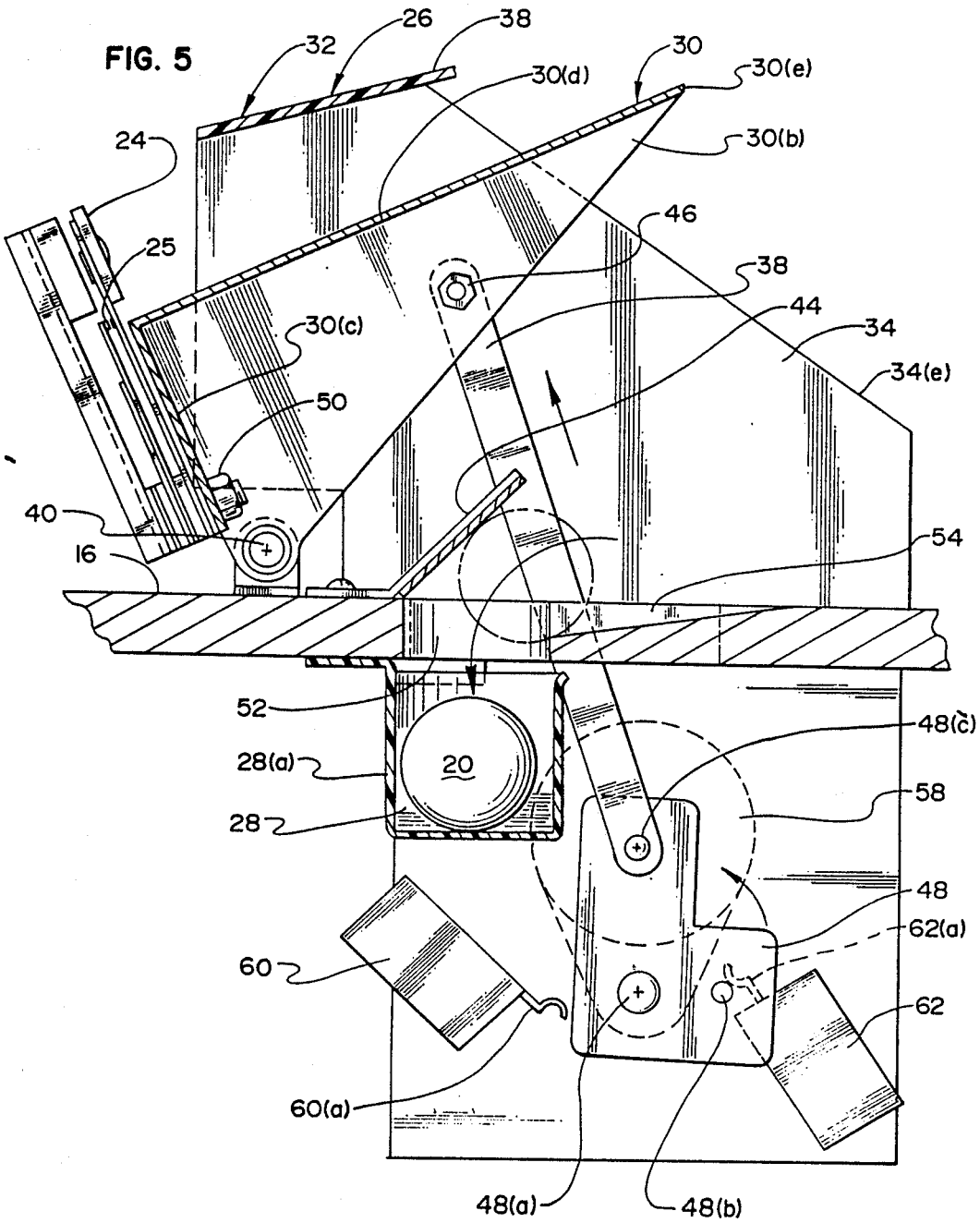
FIG. 5 is a cross-sectional elevation taken along the plane of line 5—5 of FIG. 3.

In FIGS. 4 and 5 the ramp and target structure 26 can be seen, along with its drive mechanism that is located below the playfield 16.

The targets 24 are positioned adjacent a series of switches 25. A motor 58 is connected, either directly or by a band or gears, to a crank 48 at point 48(*a*).

In the operation of the pinball machine illustrated herein, the operator pulls back and releases the ball launcher 18 propelling a ball 20 onto the playfield 16. By use of the flippers 22 the player positions the ball 20 to shoot the ball 20 towards targets 24 at the top of the ramp wall 30(*c*) inside of the ramp and target structure 26.

The ball 20 shot towards the ramp and target structure 26 travels up the ramp structure 30 on the ramp surface 30(*d*) toward a target 24. If the player is successful, the ball 20 strikes target 24 closing the switch 25. Depending on the particular program used, the switches 25 may need to be closed once or a series of times, or a number of targets 24 may need to be closed at random or in a specific sequence in order to activate the pivoting mechanisms. Upon the programed strikings an electrical signal is provided to the motor 58 causing the crank 48 to rotate about the point 48(*a*), raising the shaft 42 and causing the ramp structure 30 to pivot. Switching means 60 and 62 are provided to allow the correct rotation of the crank 48, by using stops 60(*a*) and 62(*a*) to engage a contact 48(*b*) on the crank 48, so that the ramp structure 30 is opened and closed correctly, causing no damage to the supporting structure 25 or the playfield 16. The stops 60(*a*) and 62(*a*) allow the proper opening and closing of the ramp structure 30 for the game to continue.

Upon the pivoting of the ramp structure 30, to its open position, the player may then propel the ball 20 towards the opening 52, by means of the flippers 22. The ball-guide 54 directs the ball 20 to the opening 52 and down into the path 28. Path 28 slopes beneath the playfield 16 towards a ball ejector 64, points are scored, and the ball is ejected onto playfield 16. The ejection of ball 20 causes a signal to be sent to the motor 58, reversing the action of the motor 58 and causing the ramp structure 30 to close. The ramp and target structure 26 is then reset for the next play.

Although an illustrative embodiment of the invention has been shown and described, it is to be understood that various modifications and substitutions may be made without departing from the novel spirit and scope of the present invention.

What is claimed is:

1. A pinball machine which comprises:
- a playfield;
- a ramp on which a ball can travel;
- a supporting structure carried by the playfield;
- means pivotally connecting said ramp to said supporting structure;
- a first target carried by said ramp at an angle to the slope of said ramp so as to allow engagement by a ball travelling on said ramp;
- a second target;
- means defining an opening beneath said ramp;
- means defining a path from said opening to said second target; and,
- means for pivoting said ramp so that said ramp is raised to a first position to allow access by a ball to said opening and lowered, to a second position to allow a ball travelling on said ramp to engage said first target.

2. A pinball machine as defined by claim 1, wherein said ramp is a wedge shaped metal shell.

3. A pinball machine as defined by claim 1, wherein said ramp carries one or more targets.

4. A pinball machine as defined by claim 1, wherein said supporting structure holding the ramp is carried by said playfield of the pinball machine and comprises a first wall and a second wall oppositely placed so as to support the pivot means for the ramp, and a roof carried by said first wall and said second wall.

5. A pinball machine as defined by claim 4, wherein said first wall and said second wall of said supporting structure have shapes that define a path whereby the ball travelling on the ramp cannot fall off of the surface of the ramp.

6. A pinball machine as defined by claim 1, wherein a flat metal member bent to an angle, with respect to said playfield, of less than 90 degrees and having a mirrored surface on the underside of the bent surface, is provided on the playfield below the ramp surface and between the opening in the playfield and the pivot means.

7. A pinball machine as defined by claim 1, wherein said pivoting means includes means responsive to a ball striking said first target; said responsive means electrically signaling an electric motor connected to a crank shaft to cause said ramp to pivot.

8. A pinball machine as defined in claim 1, in which said first target comprises:
- a plurality of targets;
- a plurality of switches operable by said targets;
- means to record the closings of said switches; and
- means to generate an electrical signal responsive to said switches being closed a predetermined number of times, by the order of striking of said targets, whereby said electrical signal generating means is caused to send, by said recording means, an electrical signal to said pivoting means.

9. A pinball machine which comprises:

a playfield;

a ramp on which a ball can travel;

a supporting structure carried by the playfield;

means pivotally connecting said ramp to said supporting structure;

a first target carried by said ramp at an angle to the slope of said ramp so as to allow engagement by a ball travelling on said ramp;

a second target beneath said ramp;

means for pivoting said ramp so that said ramp is raised to a first position to allow access by a ball to said second target and lowered, to a second position to allow a ball travelling on said ramp to engage said first target.

10. A pinball machine which comprises:

a playfield;

a ramp carried by said playfield;

a crank;

a shaft rotationally connected at its opposite ends to said ramp and said crank;

a motor;

means for signaling said motor so that said motor rotates said crank raising and lowering said shaft and thereby raising and lowering said ramp.

* * * * *